United States Patent [19]

Lentz

[11] 4,082,976

[45] Apr. 4, 1978

[54] SPARK PLUG DESIGN HAVING TWO ELECTRICALLY ISOLATED CENTER ELECTRODES

[75] Inventor: Lawrence R. Lentz, Toledo, Ohio

[73] Assignee: Champion Spark Plug Company, Toledo, Ohio

[21] Appl. No.: 699,847

[22] Filed: Jun. 21, 1976

[51] Int. Cl.[2] ..... H01T 13/04

[52] U.S. Cl. ..... 313/135; 313/136

[58] Field of Search ..... 313/135

[56] References Cited

U.S. PATENT DOCUMENTS

| | | | |
|---|---|---|---|
| 3,014,150 | 12/1961 | Szilagyi | 313/135 X |
| 3,048,735 | 8/1962 | Ingram | 313/135 X |
| 3,076,113 | 1/1963 | Candelise | 313/135 |

*Primary Examiner*—Rudolph V. Rolinec
*Assistant Examiner*—Darwin R. Hostetter
*Attorney, Agent, or Firm*—John C. Purdue

[57] ABSTRACT

A spark plug and connector assembly having a spark gap formed from two electrodes which are both electrically isolated from ground. The spark plug includes an insulator mounted in a tubular metal shell having a threaded end for engaging a corresponding opening into a combustion chamber in an internal combustion engine. The two electrodes are mounted within separate parallel bores through the insulator. Each electrode has a tip projecting from the insulator for defining the spark gap. The electrodes also have terminal ends which are recessed within the insulator bores. The electrode terminal ends are centered within and spaced from the walls of the bores. Tubular connectors attached to the ends of two high-voltage ignition cables are received within the insulator bores and slide telescopically onto the electrode terminal ends. The connectors are also recessed within the insulator bores to prevent arcing therebetween. The wires pass through a resilient insulating boot which tightly engages an annular groove on the exterior surface of the insulator.

5 Claims, 2 Drawing Figures

SPARK PLUG DESIGN HAVING TWO ELECTRICALLY ISOLATED CENTER ELECTRODES

BACKGROUND OF THE INVENTION

This invention relates to spark plugs and more particularly to a spark plug and connector assembly in which the spark gap is defined by two electrodes which are both electrically isolated from ground.

Spark plugs for internal combustion engines generally consist of an insulator mounted within a shell. The shell has a threaded end adapted to engage an opening leading through the head of the engine and into a combustion chamber. A center electrode is mounted within a bore through the insulator and forms a spark gap with a ground electrode attached to the shell. During operation of the engine, a high-voltage ignition system periodically applies high-voltage pulses to the center electrode. The resulting arc across the spark gap ignites a fuel-air mixture within the combustion chamber.

In certain engines, it is desirable to provide two spark plugs for each combustion chamber. Ideally, high-voltage pulses are applied simultaneously to the two spark plugs for initiating combustion at two spaced points within the combustion chamber. By providing two separate sparks, the time required for the flame to propagate across the combustion chamber is decreased and also the reliability of the engine is greatly increased. These benefits are of particular value in engines operated with lean fuel-air mixtures. Generally, two separate ignition systems have been provided, one for firing each of the two spark plugs for each combustion chamber. However, difficulty has occurred in timing the operation of the two spark plugs to fire simultaneously. Also, the use of two separate ignition systems adds considerably to the cost of the engine.

It has been suggested that a single ignition system be adapted to simultaneously fire two spark plugs in an internal combustion engine. One suggestion was to connect two conventional spark plugs in parallel between the high-voltage ignition cable and electrical ground. However, the two spark plugs will not have identical characteristics. During operation of the engine, one of the two spark plugs will fire at a voltage lower than the other spark plug and, as a consequence, only the one spark plug will fire. Another suggestion has been to connect the two spark plugs electrically in series. With this arrangement, currents will flow in series across both spark gaps and, therefore, both spark plugs must fire simultaneously. However, two conventional spark plugs cannot be connected in series since one electrode on each spark plug is grounded to the shell. It has been found that by designing a spark plug with two electrodes which are both electrically insulated from ground, a system may be constructed in which two series connected spark plugs are simultaneously operated from a single high voltage ignition system. The high-voltage ignition cable from the ignition system is connected to one of the two non-grounded electrodes. The other of the two electrodes is connected by means of a high-voltage cable to the center electrode of a conventional spark plug. As a consequence, a circuit is formed from the high-voltage ignition system through the spark plug having the two insulated electrodes and then through a conventional spark plug to electrical ground.

Early prior art suggested designing spark plugs with two electrically insulated electrodes for forming a spark gap. In one such spark plug, as shown in U.S. Pat. No. 1,217,784 which issued Feb. 27, 1917 to LaPlante, two electrically isolated electrodes are mounted within the spark plug insulator. However, one of the two electrodes is then connected to ground and the other is connected to a high-voltage ignition cable by means of a bolt terminal. Another similar type of spark plug is shown in U.S. Pat. No. 1,560,512 which issued Nov. 3, 1925 to Hirsch. Again, two electrically isolated electrodes are mounted in the insulator of a spark plug. High voltage is applied to the spark plug by means of bolt terminals. The Hirsch patent discloses the use of the spark plug in a series electrical circuit. However, difficulty occurs in making electrical connection to the Hirsch spark plug. The primary consideration in the La Plante spark plug was to provide a spark plug having an electrode configuration for reducing fouling during operation. Difficulty also occurred in making electrical connection to the La Plante spark plug.

SUMMARY OF THE INVENTION

According to the present invention, an improved spark plug and electrical connector assembly are provided for use in internal combustion engines of the type having two separate spark plugs simultaneously fired in each combustion chamber. The spark plug has a spark gap formed from two electrodes which are both electrically insulated from ground. The spark plug includes a generally tubular metal shell in which an insulator is mounted in a conventional manner. Two bores are provided to extend through the insulator generally parallel to the axis and spaced on either side of the axis of the insulator. The electrodes have tips which project from one end of the insulator and are angled towards each other to define a spark gap. The other ends of the electrodes function as electrical terminals. The terminal ends of the electrodes are recessed within the insulator bores and also are spaced from the walls of the insulator bores. Terminals attached to the ends of two high-voltage ignition cables are inserted into the insulator bores and attached to the electrode terminals. The ignition cables extend through a rubber boot which is positioned over an end portion of the spark plug insulator. The rubber boot includes an inwardly directed annular flange which cooperates with an annular groove formed in the outer surface of the insulator for holding the boot on the insulator and also for forming a moisture seal between the insulator and the boot. The boot also resiliently engages the cables for forming a moisture seal and for rataining the cables. In operation, one of the ignition cables is connected to a high-voltage ignition system while the other ignition cable is connected to the center electrode of a conventional spark plug. The conventional spark plug has a spark gap formed with a second electrode which is grounded to the spark plug shell. As a consequence, the two spark plugs are connected electrically in series. When a high-voltage ignition pulse is supplied from the ignition system, current will not flow until the voltage is sufficient to jump both spark gaps. Therefore, both spark plugs must fire simultaneously. It should be appreciated that this arrangement increases the reliability of the engine since the fouling of one of the two spark plugs will not interfere with the firing of the other spark plug.

Accordingly, it is an object of the invention to provide an improved spark plug and connector assembly for use in internal combustion engines having two separate spark plugs for each combustion chamber.

Another object of the invention is to provide an improved assembly including a spark plug having a spark gap formed from two electrodes which are both electrically isolated from ground and a connector for making an electrical connection to the two electrodes in such spark plug.

Other objects and advantages of the invention will become apparent from the following detailed description, with reference being made to the accompanying drawings.

DESCRIPTION OF THE PREFERRED EMBODIMENT

Figure 1:
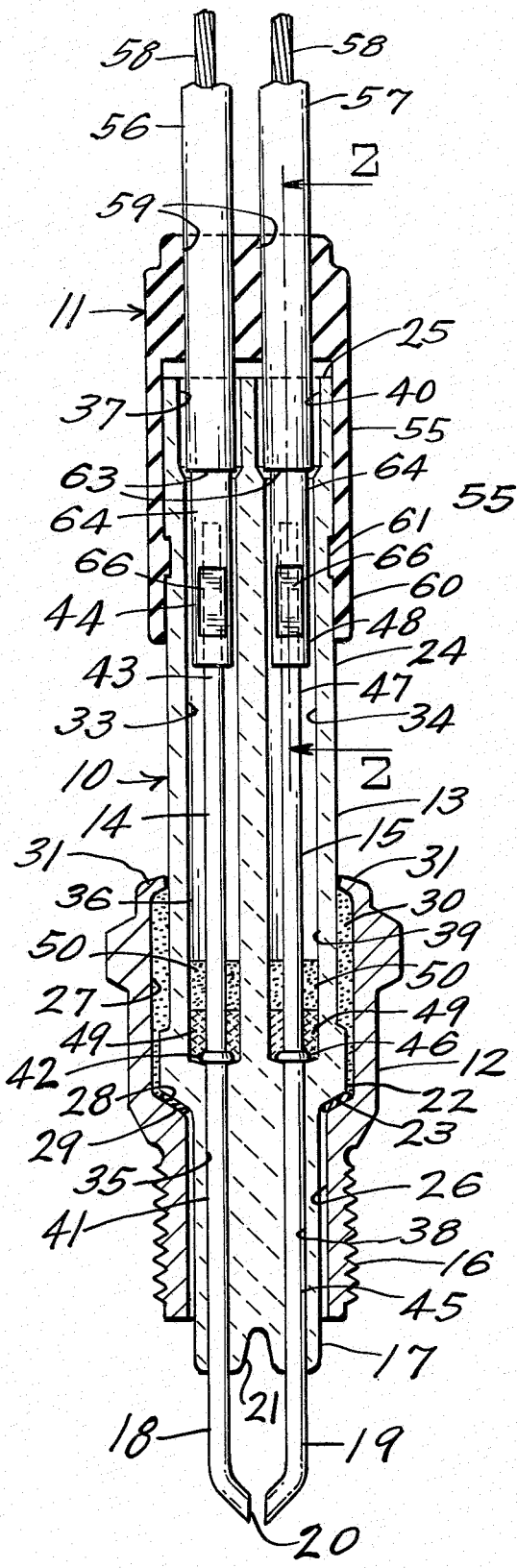
FIG. 1 is a vertical cross sectional view of a spark plug and connector assembly constructed in accordance with the present invention.

Referring now to the drawings and particularly to FIG. 1, a vertical cross sectional view is shown through a spark plug 10 and an attached connector 11 constructed in accordance with the present invention. The spark plug 10 generally comprises a tubular metal shell 12, an insulator 13 mounted in the shell 12 and two electrodes 14 and 15 mounted in the insulator 13. The shell 12 is provided with a threaded lower end 16 which is adapted to engage a cooperating threaded opening into a combustion chamber of an internal combustion engine (not shown). The insulator 13 is provided with a "nose" portion 17 which is centered coaxially within and spaced from the threaded shell end 16 and extends below the threaded shell end 16. Each of the electrodes 14 and 15 has a tip 18 and 19, respectively, which projects from the insulator nose 17. One or both of the electrode tips 18 and 19 are bent or angled towards each other for defining a spark gap 20 therebetween. Preferably, an insulator nose is provided with either a groove 21 or a ridge or projection (not shown) between the electrode tips 18 and 19 for increasing the leakage path over the surface of insulator nose 17 between the electrodes 18 and 19. When the spark plug shell 12 is threaded into a spark plug opening in the head of an internal combustion engine, the spark gap 20 projects into the combustion chamber for igniting a fuel-air mixture in a conventional manner.

As indicated above, the insulator 13 is provided with a nose section 17 at its lower end. The insulator 13 including the nose section 17 is cylindrical in shape. Above the nose section 17, the insulator 13 has an enlarged diameter flange 22. A tapered, downwardly and outwardly facing annular shoulder 23 extends between the flange 22 and the nose section 17. A main insulator body portion 24 extends from above the flange 22 to an upper insulator end 25. The insulator 13 is mounted within the tubular shell 12 to extend completely through the shell 12. The tubular shell 12 has an axial opening which includes a section 26 within the threaded end 16 having a diameter slightly greater than the diameter of the insulator nose 17. The spacing between the insulator nose 17 and the shell 12 may be larger than shown and functions to increase the surface leakage path between electrode tips 18 and 19 and the shell 12 and to control the temperature of the electrodes 18 and 19 and the insulator nose 17. Above the opening 26, the shell has an enlarged diameter opening section 27 adapted to receive the enlarged diameter insulator flange 22. Between the opening sections 26 and 27, a tapered upwardly and inwardly facing annular shoulder 28 is formed. A soft metal gasket 29 is positioned between the shell shoulder 28 and the insulator shoulder 23 for forming a gas-tight seal between the insulator 13 and the shell 12 and also for forming a heat conducting path between the insulator 13 and the shell 12. Above the insulator flange 22, generally tubular shaped pocket 30 is formed between the shell 12 and the insulator 13. The pocket 30 is filled with a compressible, resilient powdered material such as talc. The material filling the pocket 30 is tamped in place and an upper end 31 of the shell 12 is folded over such material to enclose the pocket 30. The material filling the pocket 30 is maintained in a highly compressed state to resilentally hold insulator shoulder 23 against the gasket 29 and the shell shoulder 28 for maintaining a tight seal during operation of the spark plug 10.

Two bores 33 and 34 extend through the insulator 13 for mounting the electrodes 14 and 15, respectively. The bores 33 and 34 extend in a direction substantially parallel to and on either side of the central axis of the cylindrical insulator 13. The bore 33 is stepped to include a lower section 35 of a predetermined small diameter, an intermediate diameter section 36 and a larger diameter upper section 37 adjacent to the upper insulator end 25. Similarly, the bore 34 includes a lower section 38 having a predetermined small diameter, an intermediate diameter section 39 and a larger diameter upper section 40 adjacent the upper insulator end 25. The electrode 14 has a lower section 41 which passes through the small diameter portion 35 of the bore 33. The lower electrode section 41 is of a diameter which permits insertion into the small diameter bore section 35 during assembly of the spark plug 10 yet of a sufficiently large diameter to restrict lateral movement within the bore section 35. Above the lower section 41, a shoulder 42 is provided of a diameter larger than the diameter of the lower bore section 35. The electrode 14 also has a straight terminal end 43 which extends from the shoulder 42 upwardly and coaxially in the intermediate diameter bore section 36. The terminal end 43 is of a diameter appreciably smaller than the diameter of the bore section 36 to permit attachment of a connector 44 to the terminal end 43. The electrode 15 is similar to the electrode 14 and includes a lower section 45 which is positioned within the small diameter end 38 of the bore 34. Above the lower electrode section 45, a shoulder 46 is formed with a diameter larger than the diameter of the bore section 38. From the shoulder 46, the electrode 15 has a terminal end 47 of a diameter appreciably smaller than the diameter of the intermediate section 39 to permit attaching a connector 48 to the electrode terminal end 47. Other known techniques also may be used for mounting the electrodes 14 and 15 in the bores 33 and 34. For example, the bores 33 and 34 may be straight rather than stepped and the electrodes 33 and 34 will be cemented in place. However, stepping the bores 33 and 34 is preferable.

Above the shoulder 42 on the electrode 14 and the shoulder 46 on the electrode 15, seals 49 are provided to prevent leakage of high-pressure gases in the combustion chamber through the bores 33 and 34 and also to prevent mechanical movement of the electrodes 14 and 15 in the bores 33 and 34 respectively. During manufacture of the spark plug 10, the seals 49 are formed by initially packing a powdered glass frit in the intermediate bore sections 36 and 39 at the location in which the seals 49 are to be formed. A powdered holding material 50 is then tamped over the glass frit to hold it in place during firing. The insulator 13 with the electrodes 14 and 15 held in place by the tamped glass frit and the material 50 is fired in an oven to fuse the glass frit into the glass seals 49. The material 50 merely functions to hold the glass frit and the electrodes in place during the firing operation and serves no further purpose after the firing is completed. After the insulator 13 is fired, it is then mounted in the shell 12 to complete assembly of the spark plug 10, as described above.

Figure 2:
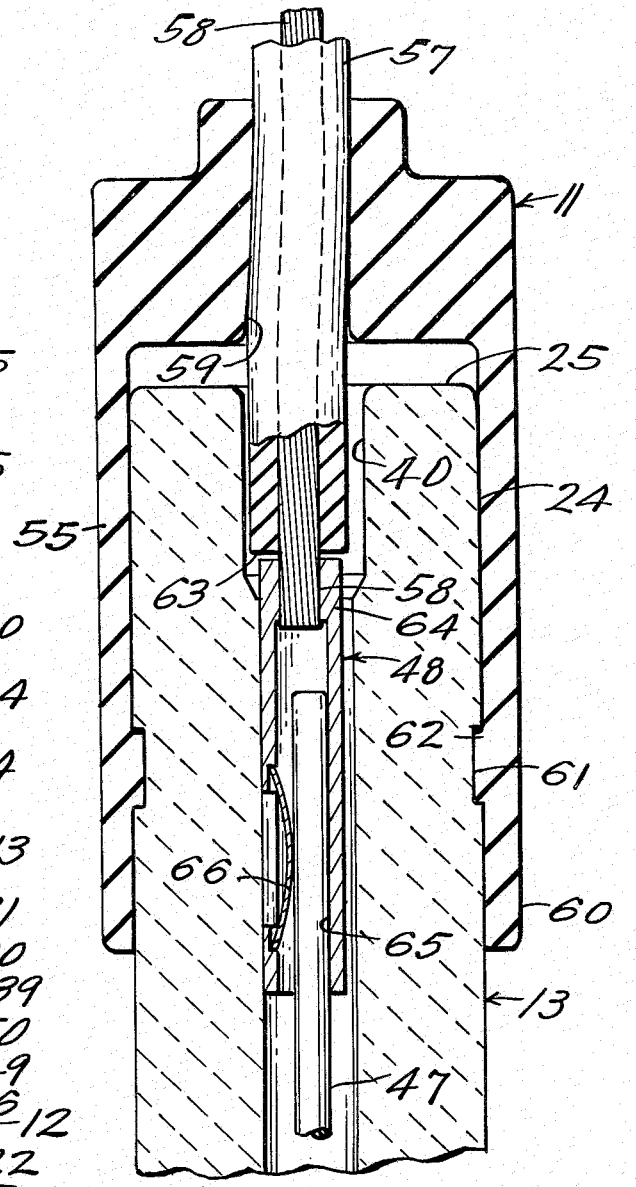
FIG. 2 is an enlarged cross sectional view taken along line 2—2 of FIG. 1.

During operation of the spark plug 10, electrical connection is made to the terminals 14 and 15 by means of the connector 11 which is shown in both FIGS. 1 and 2. The connector 11 generally consists of a boot 55 through which two high voltage ignition cables 56 and 57 extend. Each of the cables 56 and 57 has a conductor 58 to which the terminals 44 and 48 are attached, respectively. The boot 55 has two openings 59 through which the cables 56 and 57 pass. The openings 59 are preferably of a diameter smaller than the exterior diameter of the cables 56 and 57 so that the boot 55 resiliently engages and holds the wires 56 and 57. The resilient contact functions both to hold the cables 56 and 57 firmly within the boot 55 and to prevent moisture from passing between the boot 55 and cables 56 and 57. The boot 55 has a lower portion 60 which fits over and resiliently engages the main body portion 24 of the insulator 13 adjacent upper end 25. One or more annular grooves 61 are formed in the insulator body 24 adjacent end 35 for receiving a corresponding inwardly directed annular flange 62 on the interior of the lower boot portion 60. The annular flange 62 resiliently engages the groove 61 for holding the connector 11 on the spark plug 10 and also for preventing moisture from passing between the insulator 13 and the lower boot portion 60. Or, the boot 55 may simply engage the insulator body 24 adjacent the end 25 by friction. A ribbed pattern (not shown) may be formed on the insulator body 24 adjacent the end 25 to increase the friction.

The wires 56 and 57 each have lower ends 63 which project through the boot 55 sufficiently to substantially fill the larger diameter upper end sections 37 and 40 of insulator bores 33 and 34 when the connector 11 is positioned on the spark plug 10. The connectors 44 and 48 are each generally tubular in shape and have an end 64 which is crimped, soldered or otherwise attached to the ends of the conductors 58 of the cables 56 and 57, respectively. The connectors 44 and 48 each have a central opening 65 of a diameter sufficiently large to receive the terminal ends 43 and 47 of the electrodes 14 and 15, respectively. However, the exterior diameter of the connectors 44 and 48 must be sufficiently small as to readily pass into the intermediate diameter sections 36 and 39 of the bores 33 and 34. A flat resilient metal spring 66 is attached to each of the connectors 44 and 48 to project into the interior openings 65. When the connector 44 is inserted onto the terminal end 43 of the electrode 14 and the connector 48 is inserted onto terminal end 47 of the electrode 15, the springs 66 deflect to assure a positive electrical circuit connection between the connectors 44 and 48 and the electrodes 14 and 15. In a modified embodiment, the connectors 44 and 48 may be replaced with compression spring contacts (not shown) attached to the conductors 58. When the conductor 11 is placed on the spark plug 10, the boot 55 holds the cables 56 and 57 in the bores 33 and 34, respectively, with the contacts resiliently compressed against the terminal ends 43 and 47. Other known methods also may be used for electrically connecting the cables 56 and 57 with the terminal ends 43 and 47.

During operation, the spark plug 10 is attached by means of the threaded shell end 16 to a correspondingly threaded opening into a combustion chamber in an internal combustion engine. A second threaded opening is provided into the combustion chamber for receiving a conventional spark plug in which one electrode is grounded. One of the high-voltage ignition cables 56 or 57 is connected to the center electrode of the conventional spark plug, while the other of the high-voltage ignition cables 56 or 57 is connected to the ignition system for the engine. As a consequence, the spark gap 20 is connected electrically in series with the spark gap in the conventional spark plug. When the ignition system applies a high voltage over the connected cable 56 or 57, the high voltage jumps across the spark gap 20 of the spark plug 10 and the spark gap in the conventional spark plug simultaneously for initiating combustion simultaneously at two separated points within the combustion chamber. By connecting the spark plug 10 electrically in series with a conventional spark plug, a single ignition system may be used for simultaneously firing the two spark plugs. Thus, the need for duplicate ignition systems and for a sophisticated timing device for simultaneously firing the two spark plugs is eliminated.

It will be appreciated that various changes and modifications may be made in the above-described spark plug 10 and connector 11 without departing from the spirit and the scope of the following claims.

What I claim is:

1. A spark plug and connector assembly for use in an internal combustion engine comprising, in combination, a cylindrical insulator having two bores extending therethrough substantially parallel to its axis and between first and second insulator ends, each of the bores having a first section adjacent the first end of said insulator and a second section adjacent the second end of said insulator, the first bore section having a predetermined diameter and the second bore section having a predetermined larger diameter, a generally tubular shell mounting said insulator, said shell having a threaded end circumjacent the first bore sections for engaging the internal combustion engine, two electrodes each having a terminal end within one of the second bore sections extending through one of the first bore sections projecting from the first end of said insulator and having a firing end outside said insulator, the firing ends of said electrodes being in spark gap relationship with one another, and the terminal ends of each of said electrodes having a diameter smaller than the predetermined diameter of the second bore sections, means mounting each of said electrodes within said insulator, two insulated high-voltage ignition cables, and two connectors, one connector attached to and in electrical contact with an end of each of said cables, each of said connectors and an adjacent portion of the attached one of said insulated cables being entirely within one of the bores of said insulator, and each of said connectors including a generally tubular metal housing having an internal opening of a diameter greater than that of the terminal ends of said electrodes and an external diameter smaller than the predetermined diameter of the second bore sections, each of said housings being entirely within one of the second bore sections and each of the terminal ends of said electrodes being within one of said housings, and a spring projecting inwardly into the internal opening of each of said housings, and resiliently engaging an electrode terminal end.

2. A spark plug and connector assembly for use in an internal combustion engine, as set forth in claim 1, and further including an electrically insulating resilient boot having an end fitting over the second end of said insulator, and having two openings through which said insulated cables extend, and wherein the two openings of said boot have a diameter smaller than the diameter of said insulated cables whereby said boot resiliently engages said insulated cables.

3. A spark plug and connector assembly for use in an internal combustion engine, as set forth in claim 2, wherein there is a radially inwardly directed annular groove adjacent the second end of said insulator, and said boot has a radially inwardly directed flange resiliently engaging the groove in said insulator.

4. A spark plug and connector assembly for use in an internal combustion engine, as set forth in claim 1, and further including an electrically insulating resilient boot having an end fitting over the second end of said insulator, and having two openings through which said insulated cables extend, and wherein the two openings of said boot have a diameter smaller than the diameter of said insulated cables whereby said boot resiliently engages said insulated cables.

5. A spark plug and connector assembly for use in an internal combustion engine, as set forth in claim 4, wherein there is a radially inwardly directed annular groove adjacent the second end of said insulator, and said boot has a radially inwardly directed flange resiliently engaging the groove in said insulator.

* * * * *